US010077149B2

(12) United States Patent
Burger

(10) Patent No.: US 10,077,149 B2
(45) Date of Patent: Sep. 18, 2018

(54) DISPENSER FOR DOSING TABLETS OR POWDERS

(71) Applicant: JOMA KUNSTSTOFFTECHNIK GMBH & CO. KG, Brunn am Gebirge (AT)

(72) Inventor: Josef Burger, Ravelsbach (AT)

(73) Assignee: JOMA KUNSTSTOFFTECHNIK GMBH & CO. KG, Brunn am Gebirge (AT)

( * ) Notice: Subject to any disclaimer, the term of this patent is extended or adjusted under 35 U.S.C. 154(b) by 3 days.

(21) Appl. No.: 15/330,799

(22) PCT Filed: May 8, 2015

(86) PCT No.: PCT/AT2015/050115
§ 371 (c)(1),
(2) Date: Nov. 7, 2016

(87) PCT Pub. No.: WO2015/168718
PCT Pub. Date: Nov. 12, 2015

(65) Prior Publication Data

US 2017/0217664 A1 Aug. 3, 2017

(30) Foreign Application Priority Data

May 8, 2014 (AT) ..... A 338/2014

(51) Int. Cl.

| | |
|---|---|
| ***B67B 1/00*** | (2006.01) |
| ***B65D 83/04*** | (2006.01) |
| ***B65D 83/06*** | (2006.01) |
| ***B65D 81/26*** | (2006.01) |

(52) U.S. Cl.
CPC ..... *B65D 83/0409* (2013.01); *B65D 81/264* (2013.01); *B65D 83/06* (2013.01); *B65D 2101/0046* (2013.01); *B65D 2215/02* (2013.01)

(58) Field of Classification Search
CPC ..... B65D 2101/0023
USPC ..... 222/153.06
See application file for complete search history.

(56) References Cited

U.S. PATENT DOCUMENTS

| | | |
|---|---|---|
| 2009/0127157 A1 | 5/2009 | Costa et al. |
| 2011/0011883 A1 | 1/2011 | Nakkouri |

FOREIGN PATENT DOCUMENTS

| | | |
|---|---|---|
| DE | 92 17 555 | 5/1994 |
| DE | 10 2010 063 030 | 6/2012 |
| EP | 1415931 | 5/2004 |
| WO | 94/14682 | 7/1994 |
| WO | 2009/121173 | 10/2009 |

*Primary Examiner* — Lori Baker
(74) *Attorney, Agent, or Firm* — Greenblum & Bernstein, P.L.C.

(57) ABSTRACT

Dispenser for dosing tablets or powders includes a container configured to hold the tablets or the powders. A dosing device is mounted to the container and being configured to allow the tablets or the powders to be dosed via an outlet. The dosing device includes a stator having an axis and a rotor that is connected to the stator and that can rotate about the axis of the stator. The rotor has a passage opening and a bottom portion that covers an upper portion of the stator. A cap is configured to at least cover the rotor. A first tamper-indicating device connects the cap to the stator. A second tamper-indicating device connects the stator to the container. A child-proof lock is utilized.

13 Claims, 10 Drawing Sheets

FIG. 2
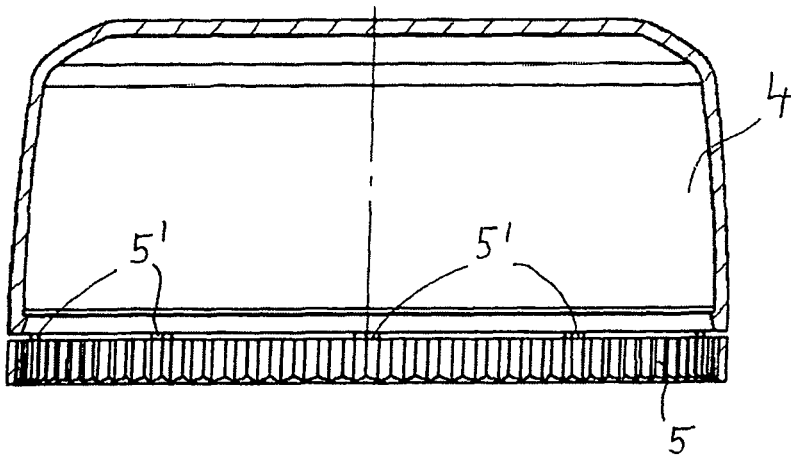
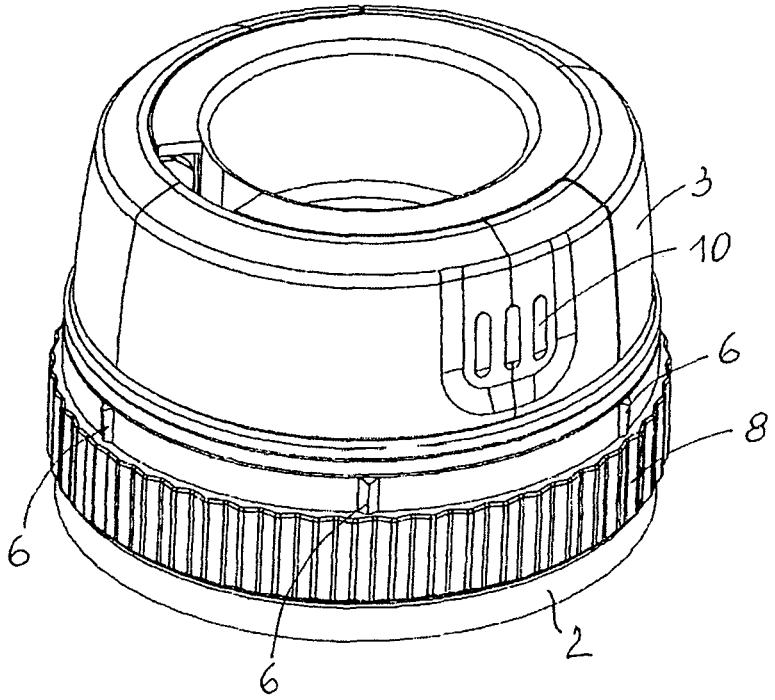
FIG. 3

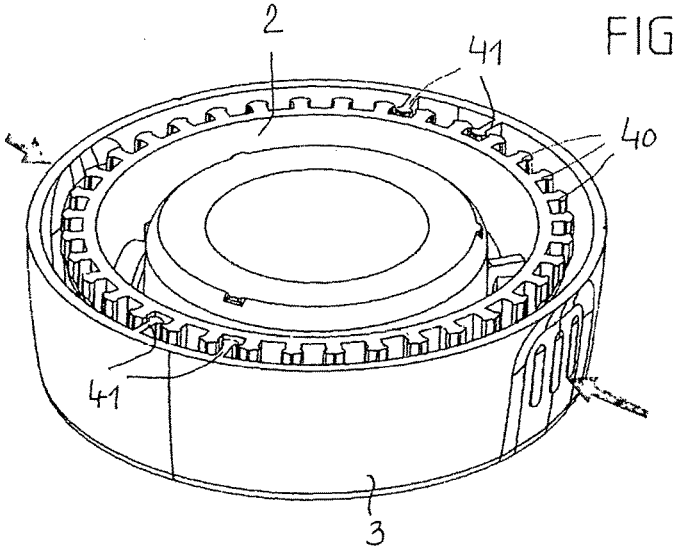
FIG. 9
FIG. 10
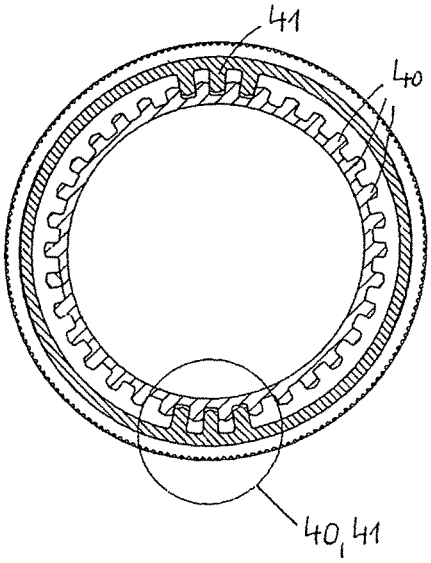
FIG. 11
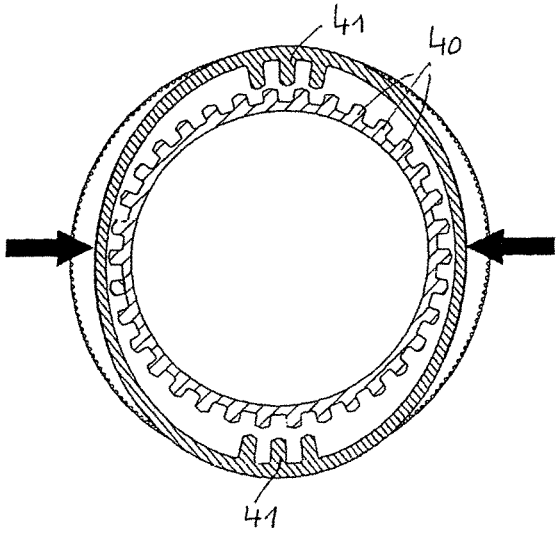

DISPENSER FOR DOSING TABLETS OR POWDERS

CROSS-REFERENCE TO RELATED APPLICATIONS

The present application is a US National Stage Application of International Application No. PCT/AT2015/050115 filed May 8, 2015 which published as WO 2015/168718 on Nov. 12, 2015. This application also claims the right of priority granted under 35 U.S.C. §§ 119 and 365 of Austrian Application No. A338/2014 filed on May 8, 2014.

BACKGROUND OF THE INVENTION

1. Field of the Invention

The invention relates to a dispenser for dosing tablets or powders comprising a container for holding the tablets or powders and a dosing element connected to the container, which dosing element is provided with an outlet for tablets or powders and comprises two parts that can be rotated in relation to each other around a common axis, namely a stator and a rotor, wherein the stator, which is connected to the container, is covered by the rotor at its periphery at the bottom except for a passage opening.

SUMMARY OF THE INVENTION

It is the object of the present invention to design such a dispenser in a way for the first user to be sure that the container is filled with original products, that this charge is complete as well and, furthermore, that use by children is at least made difficult.

To achieve this object, a cap for covering the rotor and the stator is connected to the rotor and the stator by means of a first tamper-indicating device, the rotor and the stator are connected to the container by means of a second tamper-indicating device, and the dispenser is equipped with a child-proof lock.

The provisions according to the invention prevent that 1. the container is opened without this being noticed later on,
2. tablets or powders were taken from the container by an appropriate turning of the stator and the rotor in opposite directions, and
3. children might gain access to the content of the container.

In the context of the invention, the child-proof lock may be designed such that at its periphery the stator is provided with a toothing or teeth which is engaged by at least one toothed segment of the rotor, which rotor is made of an elastically deformable material. In order to turn the stator and the rotor in opposite directions, the rotor must thus be deformed elastically to form an oval.

To support this purpose, the teeth of the rotor and those of the toothed segment are designed hook-shaped on both sides of their ends. This allows a secure hooking of the teeth.

In their engaging region the hooks are rounded advantageously.

A different embodiment of the child-proof lock provides that the stator is provided with at least one elastically deformable actuator button, which is disposed in an opening of the rotor when in the rest position. In order to achieve a turning of the stator and the rotor in opposite directions, the actuator button must be pressed. Two opposite buttons are favorably arranged on this embodiment.

What the child-proof locks described above have in common is that pressure must be applied to the rotor or the stator and/or to an element connected to the rotor or the stator while simultaneously turning the rotor and the stator with respect to one another. Since (small) children are usually not able to perform a combined press-and-turn move like this, such devices are well suited as child-proof locks according to the invention.

A different design of the lock is distinguished by the container comprising at least one protrusion extending to the inside, cooperating with a resilient arm arranged on the rotor in such a way that after moving the arm past the protrusion a turning-back is blocked.

The rotor may also be provided with a receptacle for a drying agent. This constitutes a further safety measure.

The invention is described in more detail by means of the drawings below, illustrating exemplary embodiments to which the invention is not limited in any way.

BRIEF DESCRIPTION OF THE DRAWINGS

FIG. 2 shows the cap of the dispenser according to FIG. 1;

FIG. 3 shows the rotor connected to the stator of the dispenser according to FIG. 1;

FIG. 9 shows a diagrammatic illustration of a child-proof lock;

FIG. 10 shows the child-proof lock according to FIG. 9 in a non-deformed state;

FIG. 11 shows the child-proof lock according to FIG. 9 in a deformed state;

DETAILED DESCRIPTION OF THE INVENTION

Figure 1:
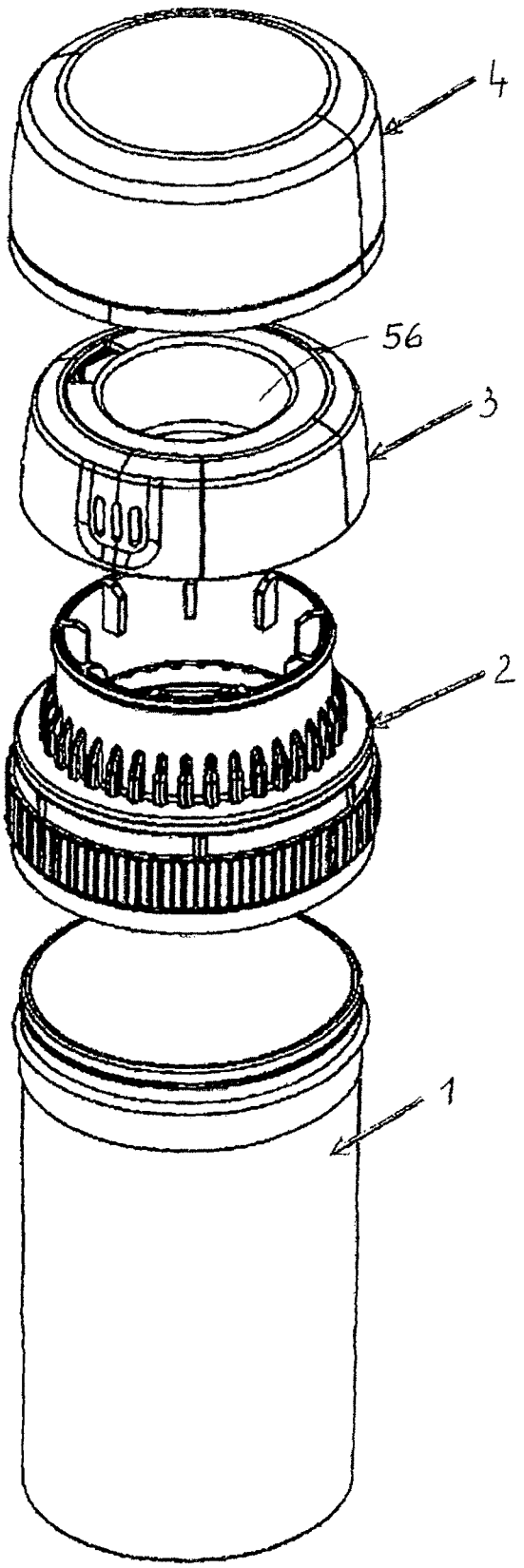
FIG. 1 shows the individual parts of a dispenser for dosing tablets pictured above one another.

According to FIG. 1 a dispenser for dosing tablets is composed of a container 1, a stator 2, a rotor 3 and a cap 4.

According to FIG. 2 a tamper-indicating strip 5 is connected to the cap 4 via webs 5'. In the assembled state, the cap 4 together with the tamper-indicating strip 5 is pushed onto the rotor 3 and the stator 2, where the tamper-indicating strip 5 engages protrusions 6 in a hook-like fashion.

During first use of the dispenser, the cap 4 is removed, breaking the webs 5' in the process. The tamper-indicating strip 5 remains on the stator 2.

This makes it possible to see whether the cap 4 has been previously removed at all times.

Figure 4:
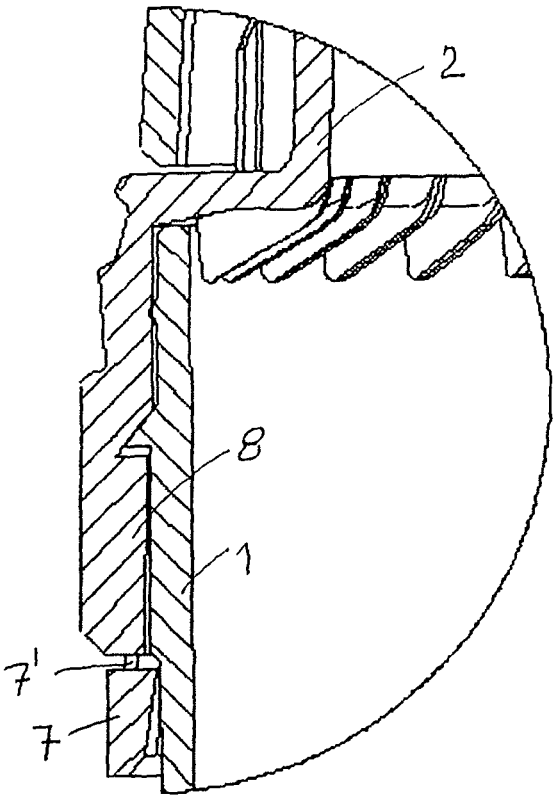
FIG. 4 shows a section for illustrating the connection of the container and the stator of a dispenser according to FIG. 1.

FIG. 4 shows that the container 1 is also connected to the stator 2 via a tamper-indicating strip 7. This strip 7 is connected to a fluted part 8 of the stator 2 via narrow webs 7'. When trying to remove the container 1, the webs 7' are torn so any tampering can be seen immediately.

Figure 5:
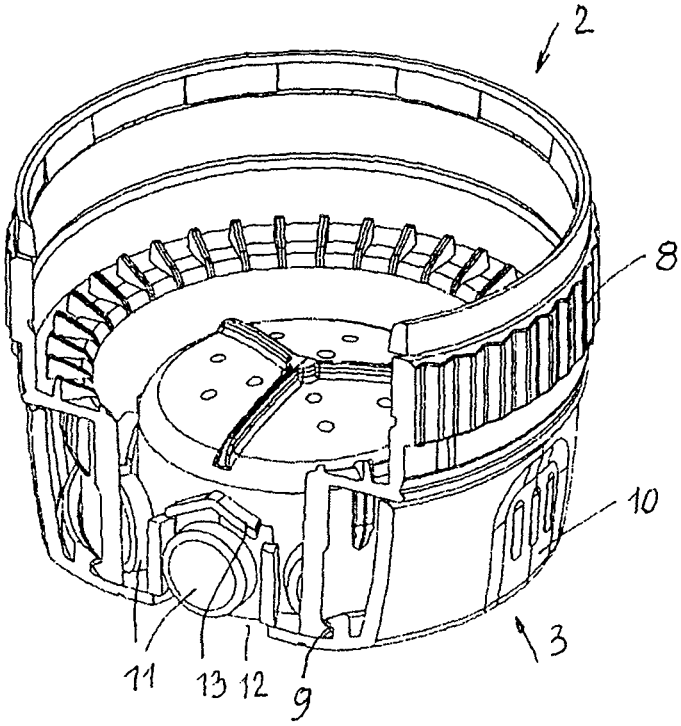
FIG. 5 shows a diagrammatic illustration of the stator and the rotor when delivering a tablet.

FIG. 5 illustrates the inner setup of the stator 2 and the rotor 3. The two parts 2 and 3 are rotatably connected to one another at 9, with a desired rotation being accomplished via two opposite actuator surfaces 10.

Advantageously, the stator 2 receives tablets 11 coming from the container 1 in individual chambers and is covered by the rotor 3 at the bottom except for a passage opening 2. If, after pressing the actuator surfaces 10, which act as a child-proof lock, the rotor 2 is turned with respect to the stator 1 until a tablet 11, which is advantageously placed within a chamber, is positioned above the passage opening 12. Then, the tablet 11 is dropped automatically and the chamber of the stator 2 is covered by a shield 13 connected to the rotor 3 in order to prevent further tablets 11 from following.

If more tablets are desired, the rotor 3 is simply turned again as often as necessary to reach the required quantity.

Figure 6:
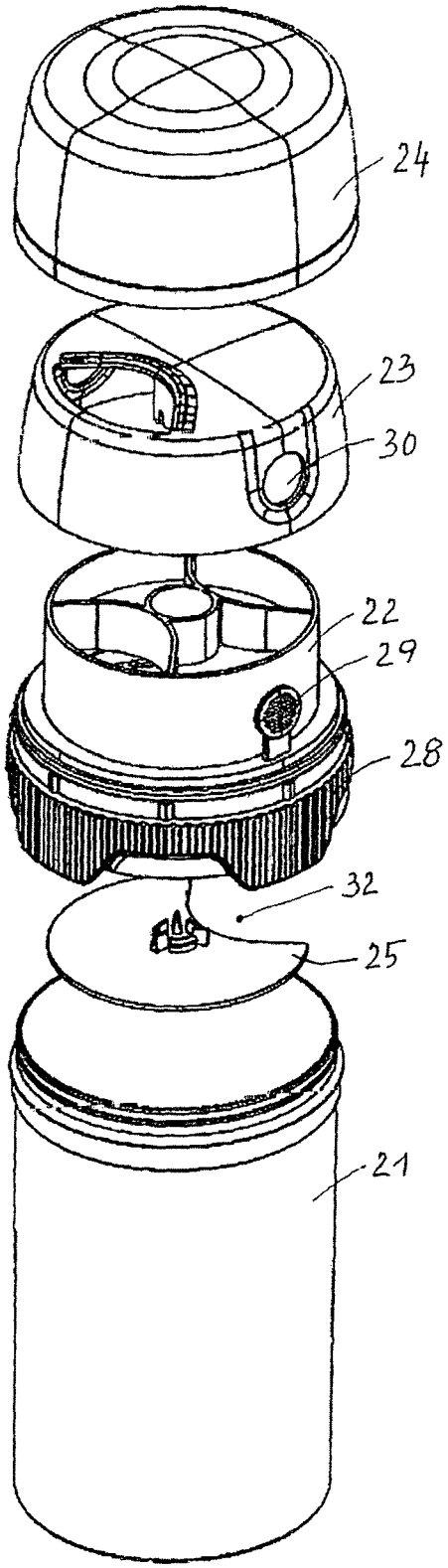
FIG. 6 shows the individual parts of a dispenser for dosing powders pictured above one another.

The individual parts of a dispenser for dosing powders are illustrated above one another in FIG. 6. According to this, a container 21, a stator 22, a rotor 23 and a cap 24 are present. A separating disc 25 is shown as well.

As in the dispenser for tablets, a tamper-indicating strip (not illustrated) is provided between the cap 24 and the stator 22.

A tamper-indicating strip is also disposed between the container 21 and the stator 22. The only difference from the embodiment described above is that this strip is divided into individual sections so the fluted part 28 of the stator 22 is cut out. However, this only changes the appearance of the dispenser.

As the child-proof lock in this exemplary embodiment two elastic deformable actuator buttons 29 are disposed, resting in openings 30 of the rotor 23 when in their rest positions. The rotor 23 can only be turned after pressing in the actuator buttons 29.

Figure 8:
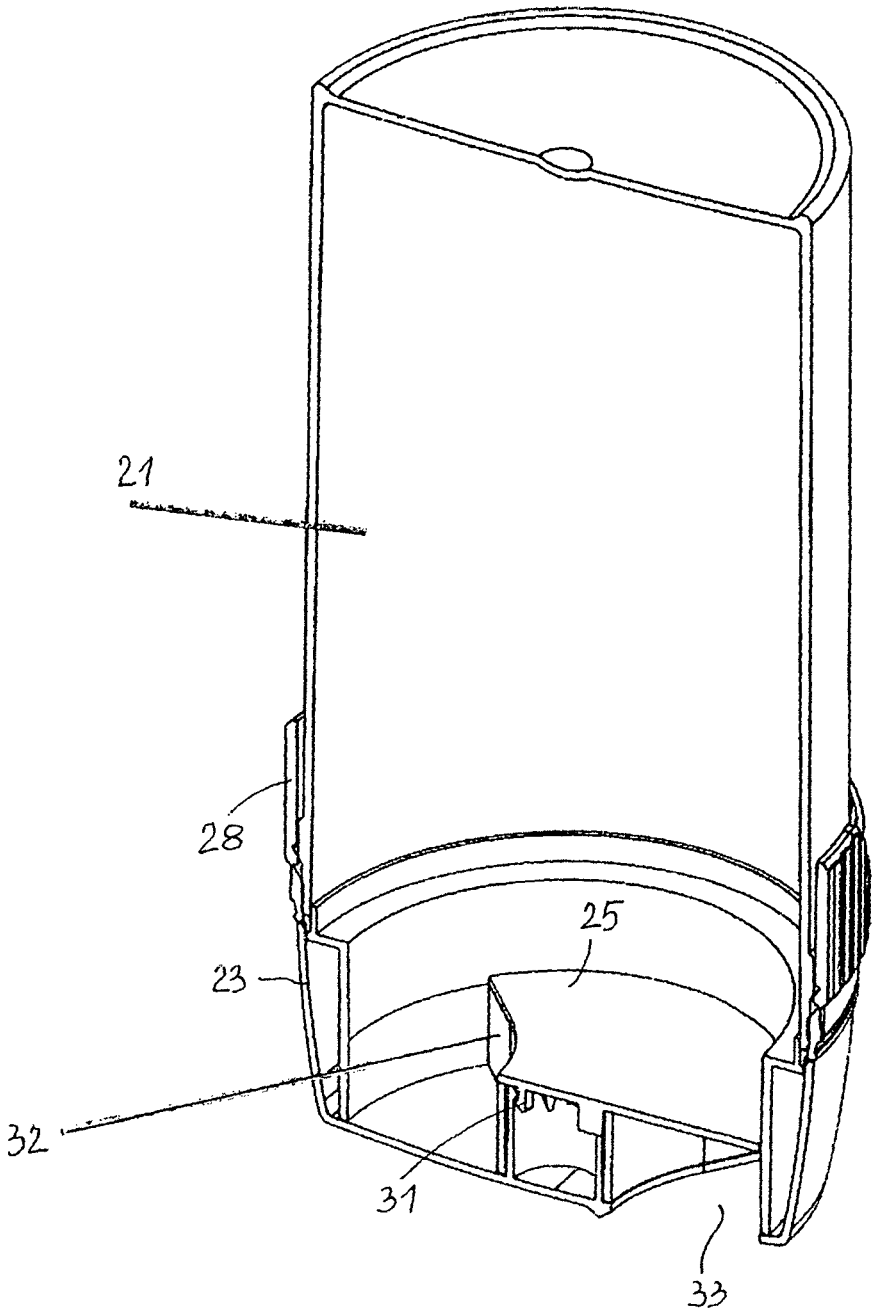
FIG. 8 shows a diagrammatic illustration of a section through the dispenser for dosing powders.
Figure 12:
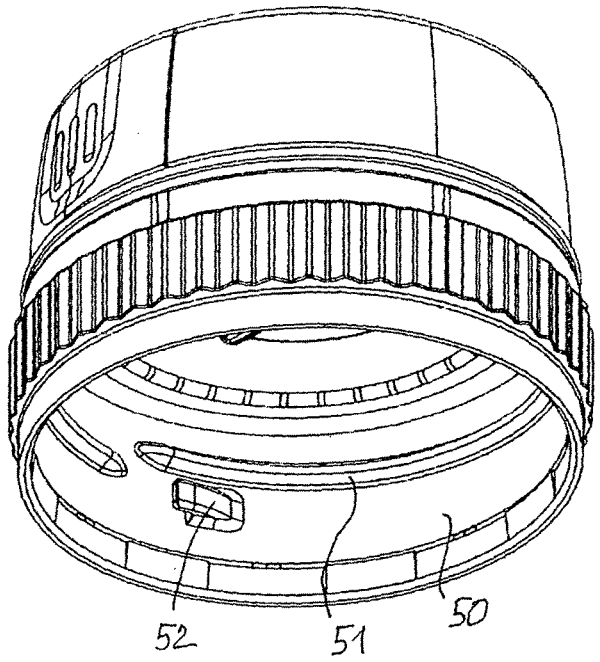
FIG. 12 shows the diagrammatic bottom view of a stator and a rotor for screwing onto a container.

According to FIG. 8, the separating disc 25 is non-rotatably connected to the rotor 23 via a snap-on connection 31. The separating disc 25 has a cut-out 32 the size of which equals the passage opening 33.

This means that if the rotor 23 is turned together with the separating disc 25 far enough for the cut-out 32 to be positioned above the passage opening 33, powder held in the container 21 may pour out.

FIGS. 9 to 11 illustrate a child-proof lock which might be used in the dispenser for tablets according to FIG. 1.

According to this, the stator 2 is provided with a toothing or teeth 40 on its periphery which grips the rotor 3 on its inside, and the rotor 3 made of elastically deformable materials comprises at least one toothed segment 41 which, in the undeformed or non-deformed state, engages the toothing 40 of the stator 2. Should the rotor 3 deform as indicated by the arrows in FIG. 11, the teeth of the toothed segment or the toothed segments 41 disengage the toothing 40 of the stator 2 and the rotor 3 may be turned.

FIGS. 12 to 15 illustrate a device for preventing a turning-back of a stator screwed onto a container. In the example, the stator 50 is provided with a thread 51 for screwing it onto a container (not illustrated). Furthermore, the stator 50 comprises a resilient arm 52 cooperating with the protrusion 53 according to FIGS. 13, 14 and 15.

Figure 13:
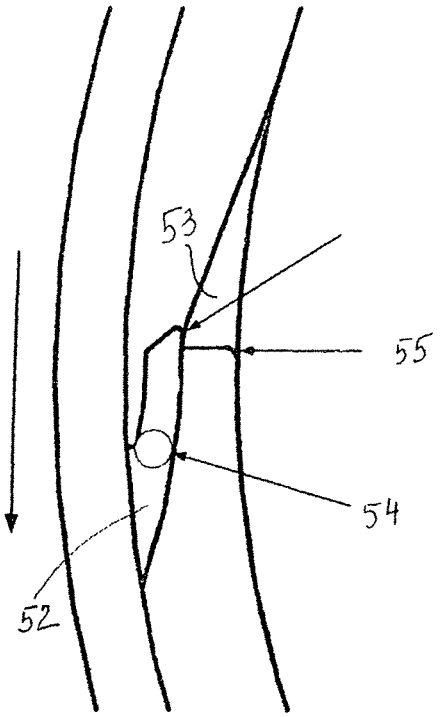
FIGS. 13 to 15 show schematic illustrations of the arrangement for preventing a turning-back of the stator and the rotor according to FIG. 12.

According to FIG. 13, when screwing the stator 50 and moving the resilient arm 52 past the protrusion 53, the arm 52 resiliently moves to the outside around the imaginary pivot point 54 and slides over the ramp-like protrusion 53.

Figure 14:
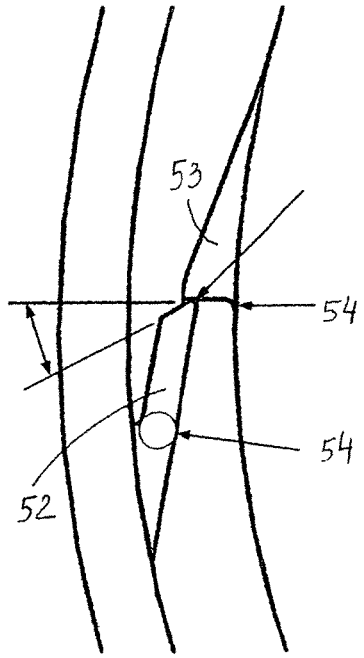

After completing this movement, the resilient arm 52 bounces to the inside again and rests against the face of the protrusion 53 (FIG. 14).

Figure 15:
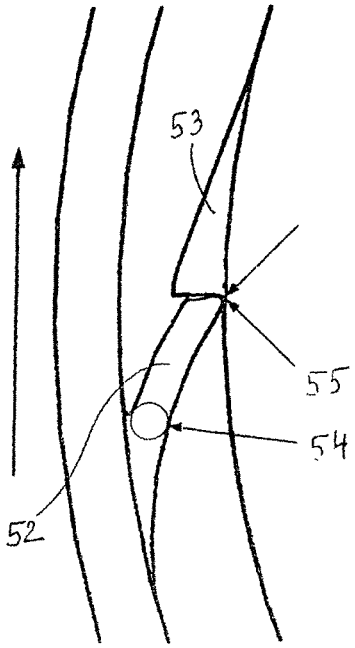

When trying to unscrew, the contact edge of the resilient arm 52 slides along the protrusion 53 to the corner 55 and thus blocks any further returning movement (FIG. 15).

Figure 16:
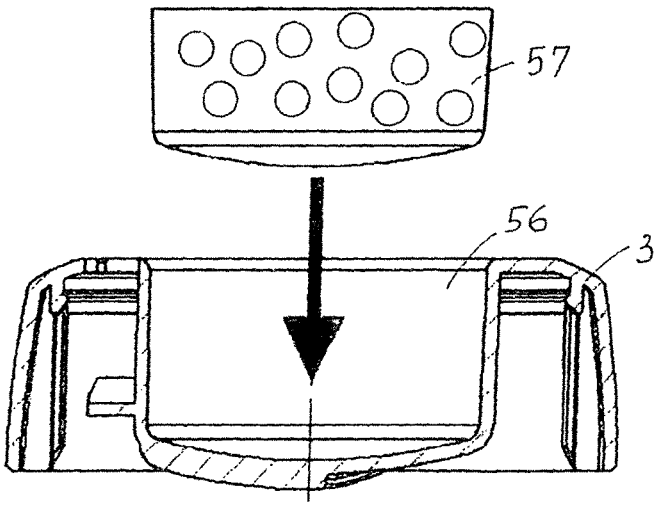
FIG. 16 shows a receptacle for a drying agent.

FIG. 16 illustrates, as can also be seen in FIG. 1, that the rotor 3 is provided with a receptacle 56 for a drying agent 57.

Figure 17:
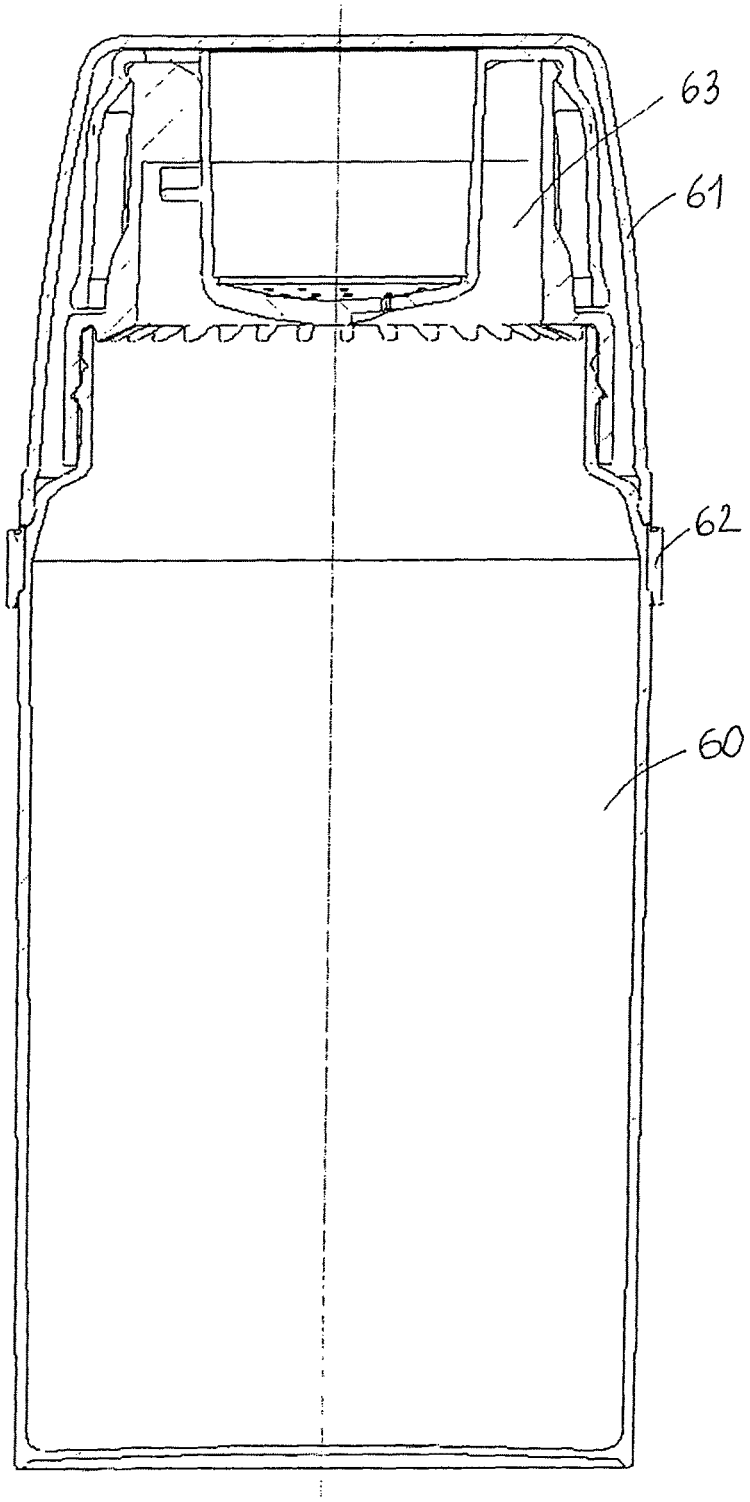
FIG. 17 shows a further exemplary embodiment of a tamper-indicating device.

FIG. 17 illustrates an embodiment in which the dedicated quality device between the rotor and the stator is omitted and the container 60 is directly connected to a cap 61 via a tamper-indicating device 62. The cap 61 contains the unit 63 composed of the stator and the rotor.

Figure 7:
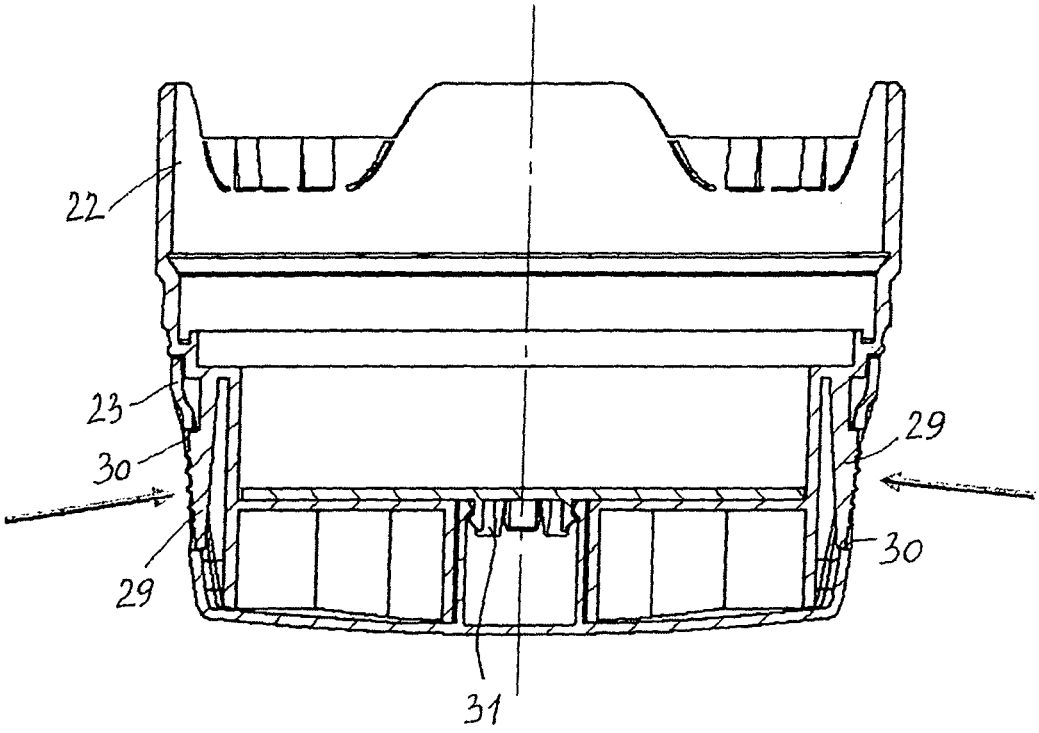
FIG. 7 shows a section through the stator with the rotor connected thereto of the dispenser according to FIG. 6.

In the context of the invention, numerous modifications are possible. For example, the child-proof lock according to FIGS. 9 to 11 may also be used in a dispenser for delivering powder ac-cording to FIG. 6 and/or a child-proof lock according to FIG. 7 might be possible in a dispenser for tablets according to FIG. 1. Actually, the use of other child-proof locks is also contemplated. The type of the tamper-indicating devices is not limited to the illustrated examples, either.

The invention claimed is:

1. A dispenser for dosing tablets or powders, comprising:
- a container configured to hold the tablets or the powders;
- a dosing device mounted to the container and being configured to allow the tablets or the powders to be dosed via an outlet;
- said dosing device comprising:
  - a stator having an axis; and
  - a rotor that is connected to the stator and that can rotate about the axis of the stator;
- said rotor having a passage opening and a bottom portion that covers an upper portion of the stator;
- a cap configured to at least cover the rotor;
- a first tamper-indicating device connecting the cap to the stator;
- a second tamper-indicating device connecting the stator to the container;
- a child-proof lock that is disengaged when one of:
  - pressure is applied to the rotor or an element connected to the rotor while simultaneously the rotor and the stator are caused to rotate relative to one another; or
  - pressure is applied to the stator or an element connected to the stator while simultaneously the rotor and the stator are caused to rotate relative to one another.

2. The dispenser of claim 1, wherein the stator comprises teeth and the rotor comprises teeth that can engage with the teeth of the stator.

3. The dispenser of claim 2, wherein the rotor comprises an elastically deformable wall and the teeth of the rotor are arranged on the elastically deformable wall.

4. The dispenser of claim 3, wherein the teeth of the rotor are arranged on a segment of teeth.

5. The dispenser of claim 3, wherein the teeth of the rotor are hook-shaped or have a hook-shaped end.

6. The dispenser of claim 5, wherein the teeth of the rotor have a rounded engaging region.

7. The dispenser of claim 3, wherein the teeth of the stator are hook-shaped or have a hook-shaped end.

8. The dispenser of claim 7, wherein the teeth of the rotor have a rounded engaging region.

9. The dispenser of claim 1, wherein the stator comprises at least one elastically deformable actuator button and the rotor comprises an opening that allows access to the at least one elastically deformable actuator button when the rotor is in a predetermined position.

10. The dispenser of claim 1, wherein the container comprises at least one protrusion that is engagable with a resilient arm arranged on the stator, whereby the at least one protrusion and the resilient arm can prevent rotation of the stator relative to the container in a rotation direction.

11. The dispenser of claim 1, wherein the rotor comprises a receptacle configured to receive a drying agent.

12. The dispenser of claim 1, wherein the cap covers the rotor and the stator.

13. A dispenser for dosing tablets or powders, comprising:

a container having an upper end and being configured to hold the tablets or the powders;

a dosing device mounted to the upper end the container and being configured to allow the tablets or the powders to be dosed;

said dosing device comprising:

a stator having an axis; and a rotor that is connected to the stator and that can rotate about the axis of the stator;

said rotor having a passage opening and a bottom portion that covers an upper portion of the stator;

a removable cap configured to cover the rotor and the stator;

at least one tamper-indicating device connecting one of:

the cap to the stator;

the stator to the upper end of the container; or the cap to the upper end of the container;

a child-proof lock that is disengaged when one of:

pressure is applied to the rotor or an element connected to the rotor while simultaneously the rotor and the stator are caused to rotate relative to one another; or pressure is applied to the stator or an element connected to the stator while simultaneously the rotor and the stator are caused to rotate relative to one another.

* * * * *